US008718302B2

(12) United States Patent
Edwards et al.

(10) Patent No.: US 8,718,302 B2
(45) **Date of Patent: *May 6, 2014**

(54) MIXING OF IN-THE-EAR MICROPHONE AND OUTSIDE-THE-EAR MICROPHONE SIGNALS TO ENHANCE SPATIAL PERCEPTION

(75) Inventors: Brent Edwards, San Francisco, CA (US); Sridhar Kalluri, El Cerrito, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/341,555

(22) Filed: Dec. 30, 2011

(65) Prior Publication Data

US 2012/0308057 A1 Dec. 6, 2012

Related U.S. Application Data

(63) Continuation of application No. 12/174,450, filed on Jul. 16, 2008, now Pat. No. 8,107,654, which is a continuation-in-part of application No. 12/124,774, filed on May 21, 2008, now abandoned.

(51) Int. Cl.
*H04R 25/00* (2006.01)

(52) U.S. Cl.
USPC ..... 381/312; 381/317; 381/318

(58) Field of Classification Search
USPC ..... 381/312–313, 316–318, 320, 322, 328
See application file for complete search history.

(56) References Cited

U.S. PATENT DOCUMENTS

| | | | | |
|---|---|---|---|---|
| 4,596,902 | A * | 6/1986 | Gilman | 381/320 |
| 5,481,615 | A * | 1/1996 | Eatwell et al. | 381/71.6 |
| 5,715,319 | A | 2/1998 | Chu | |
| 5,937,070 | A | 8/1999 | Todter et al. | |

(Continued)

FOREIGN PATENT DOCUMENTS

| | | | |
|---|---|---|---|
| EP | 1773098 | A1 | 4/2007 |
| WO | WO-2009049320 | A1 | 4/2009 |

OTHER PUBLICATIONS

"U.S. Appl. No. 12/174,450, Non Final Office Action mailed Jun. 24, 2011", 7 pgs.

(Continued)

*Primary Examiner* — Suhan Ni
(74) *Attorney, Agent, or Firm* — Schwegman, Lundberg & Woessner, P.A.

(57) ABSTRACT

This document provides a hearing assistance device for playing processed sound inside a wearer's ear canal, the hearing assistance device comprising a first housing, signal processing electronics disposed at least partially within the first housing, a first microphone connected to the first housing, the first microphone adapted for reception of sound, a second microphone configured to receive sound from inside the wearer's ear canal when the hearing assistance device is worn and in use and microphone mixing electronics in communication with the signal processing electronics and in communication with the first microphone and the second microphone, the microphone mixing electronics adapted to combine low frequency information from the first microphone and high frequency information from the second microphone to produce a composite audio signal.

20 Claims, 5 Drawing Sheets

(56) References Cited

U.S. PATENT DOCUMENTS

| | | | | |
|---|---|---|---|---|
| 5,987,146 | A | 11/1999 | Pluvinage et al. | |
| 6,658,122 | B1 * | 12/2003 | Westermann et al. | 381/312 |
| 6,674,862 | B1 | 1/2004 | Magilen | |
| 6,937,738 | B2 | 8/2005 | Armstrong et al. | |
| 7,324,649 | B1 | 1/2008 | Knapp et al. | |
| 7,756,282 | B2 | 7/2010 | Rass et al. | |
| 8,107,654 | B2 * | 1/2012 | Edwards et al. | 381/312 |
| 8,111,849 | B2 * | 2/2012 | Tateno et al. | 381/317 |
| 2004/0202340 | A1 | 10/2004 | Armstrong et al. | |
| 2005/0196001 | A1 | 9/2005 | Rass | |
| 2006/0045282 | A1 | 3/2006 | Reber | |
| 2006/0078141 | A1 | 4/2006 | Jessen et al. | |
| 2007/0009107 | A1 | 1/2007 | Lange | |
| 2009/0290739 | A1 | 11/2009 | Edwards et al. | |

OTHER PUBLICATIONS

"U.S. Appl. No. 12/174,450, Notice of Allowance mailed Sep. 27, 2011", 5 pgs.
"U.S. Appl. No. 12/174,450, Response filed Sep. 1, 2011 to Non Final Office Action mailed Jun. 24, 2011", 11 pgs.
"European Application Serial No. 09251353.0, Extended European Search Report mailed Jan. 28, 2011", 7 pgs.
"European Application Serial No. 09251353.0, Response filed Sep. 1, 2011 to Extended European Search Report mailed Jan. 28, 2011", 22 pgs.
"European Application Serial No. 09251353.0, Office Action mailed Jan. 25, 2013", 6 pgs.
"European Application Serial No. 09251353.0, Response filed May 28, 2013 to Examination Notification Art. 94(3) mailed Jan. 25, 2013", 13 pgs.

* cited by examiner

MIXING OF IN-THE-EAR MICROPHONE AND OUTSIDE-THE-EAR MICROPHONE SIGNALS TO ENHANCE SPATIAL PERCEPTION

RELATED APPLICATIONS

This application is a continuation of and claims the benefit of priority under 35 U.S.C. §120 to U.S. patent application Ser. No. 12/174,450, entitled "MIXING OF IN-THE-EAR MICROPHONE AND OUTSIDE-THE-EAR MICROPHONE SIGNALS TO ENHANCE SPATIAL PERCEPTION," filed on Jul. 16, 2008, which is a continuation-in-part of and claims the benefit of priority under 35 U.S.C. §120 to U.S. Ser. No. 12/124,774, entitled "MIXING OF IN-THE-EAR MICROPHONE AND OUTSIDE-THE-EAR MICROPHONE SIGNALS TO ENHANCE SPATIAL PERCEPTION," filed on May 21, 2008, the benefit of priority of each of which is claimed hereby, and each of which are incorporated by reference herein in its entirety.

TECHNICAL FIELD

This document relates to hearing assistance devices and more particularly to hearing assistance devices providing enhanced spatial sound perception.

BACKGROUND

Behind-the-ear (BTE) designs are a popular form factor for hearing assistance devices, including hearing aids. BTE's allow placement of multiple microphones within the relatively large housing when compared to in-the-ear (ITE) and completely-in-the-canal (CIC) form factor housings. One drawback to BTE hearing assistance devices is that the microphone or microphones are positioned above the pinna of the user's ear. The pinna of the user's ear, as well as other portions of the user's body, including the head and torso, provide filtering of sound received by the user. Sound arriving at the user from one direction is filtered differently than sound arriving from another direction. BTE microphones lack the directional filtering effect of the user's pinna, especially with respect to high frequency sounds. Custom hearing aids, such as CIC devices, have microphones placed at or inside the entrance to the ear canal and therefore do capture the directional filtering effects of the pinna, but many people prefer to wear BTE's rather than these custom hearing aids because of comfort and other issues. CICs typically only have omnidirectional microphones because the port spacing necessary to accommodate directional microphones is too small. Also, were a CIC to have a directional microphone, the reflections of sound from the pinna could interfere with the relationship of sound arriving at the two ports of the directional microphone. There is a need to be able to provide the directional benefit obtained from a BTE while also providing the natural pinna cues that affect sound quality and spatialization of sound.

SUMMARY

This document provides method and apparatus for providing users of hearing assistance devices, including hearing aids, with enhanced spatial sound perception. In one embodiment, a hearing assistance device for enhanced spatial perception includes a first housing adapted to be worn outside a user's ear canal, a first microphone mechanically coupled to the first housing, hearing assistance electronics coupled to the first microphone and a second microphone coupled to the hearing assistance electronics and adapted for wearing inside the user's ear canal, wherein the hearing assistance electronics are adapted to generate a mixed audio output signal including sound received using the first microphone and sound received using the second microphone. In one embodiment, a hearing assistance device is provided including hearing assistance electronics adapted to mix low frequency components of acoustic sounds received using the first microphone with high frequency components of sound received using the second microphone. In one embodiment, a hearing assistance device is provided including hearing assistance electronics adapted to extract spatial characteristics from sound received using the second microphone and generate a modified first signal, wherein the modified first signal includes sound received using the first microphone and enhanced components of the extracted spatial characteristics. One method embodiment includes receiving a first sound using a first microphone positioned outside a user's ear canal, receiving a second sound using a second microphone positioned inside the user's ear canal, mixing the first and second sound electronically to form an output signal and converting the output signal to emit a sound inside the user's ear canal using a receiver, wherein mixing the first and second sound electronically to form an output signal includes electronically mixing low frequency components of the first sound with high frequency components of the second sound.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

Figure 1A:
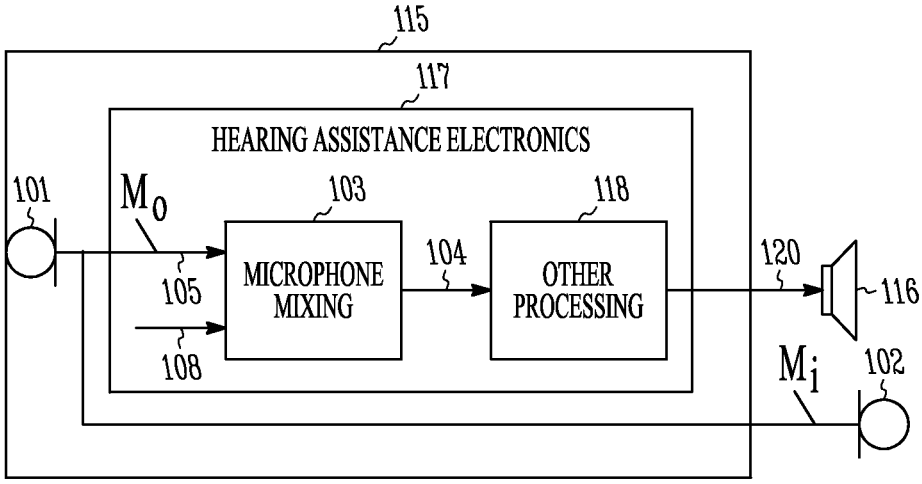
FIG. 1A is a block diagram of a hearing assistance device according to one embodiment of the present subject matter.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment.

The following detailed description is, therefore, not to be taken in a limiting sense, and the scope is defined only by the appended claims, along with the full scope of legal equivalents to which such claims are entitled.

Behind-the-ear (BTE) designs are a popular form factor for hearing assistance devices, particularly with the development of thin-tube/open-canal designs. Some advantages of the BTE design include a relatively large amount of space for batteries and electronics and the ability to include a large directional or multiple omni-directional microphones within the BTE housing.

One disadvantage to the BTE design is that the microphone, or microphones, are positioned above the user's pinna and, therefore, the spatial effects of the pinna are not received by the BTE microphone(s). In general, sounds arriving at a person's ear experiences a head related transfer function (HRTF) that filters the sound differently depending on the direction, or angle, from which the sound arrived. A sound wave arriving from in front of a person is filtered differently than sound arriving from behind the person. This filtering is due in part to the person's head and torso and includes effects resulting from the shape and position of the pinna with respect to the direction of the sound wave. The pinna effects are most pronounced with sound waves of higher frequency, such as frequencies characterized by wavelengths of the same as or smaller than the physical dimensions of the head and pinna. Spectral notches that occur at high frequencies and vary with elevation or arrival angle no longer exist when using a BTE microphone positioned above the pinna. Such notches provide cues used to inform the listener at which elevation and/or angle a sound source is located. Without the filtering effects of the pinna, high frequency sounds received by the BTE microphone contain only subtle cues, if any, as to the direction of the sound source and result in confusion for the listener as to whether the sound source is in front, behind or to the side of the listener.

Loss of pinna and ear canal effects can also impair the externalization of sound where sound sources no longer sound as if spatially located a distance away from the listener. Externalization impairment can also result in the listener perceiving that sound sources are within the listeners head or are located mere inches from the listeners ear.

Therefore, sounds received by a CIC device microphone include more pronounced directional cues as to the direction and elevation of sound sources compared to a BTE device. However, current CIC housings limit the ability to use directional microphones. Directional microphones, as opposed to omni-directional microphones, assist users hearing certain sound sources by directionally attenuating unwanted sound sources outside the direction reception field of the microphone. Although omni-directional microphones used in CIC devices provide directional cues to the listener.

The following detailed description refers to reference characters $M_o$ and M. The reference characters are used in the drawings to assist the reader in understanding the origin of the signals as the reader proceeds through the detailed description. In general, $M_o$ relates to a signal generated by a first microphone positioned outside of the ear and typically situated in a behind-the-ear portion of a hearing assistance device, such as a BTE hearing assistance device or Receiver-in-canal (RIC) hearing assistance device. $M_i$ relates to a signal generated by a second microphone for receiving sound from a position proximal to the wearer's ear canal, such sound having pinna cues. It is understood that BTE's, RIC's and other types of hearing assistance devices may include multiple microphones outside of the ear, any of which may provide the $M_o$ microphone signal alone or in combination.

FIG. 1A illustrates a block diagram of a hearing assistance device according to one embodiment of the present subject matter. FIG. 1A shows a hearing assistance device housing 115, including a first microphone 101 and hearing assistance electronics 117, a receiver (or speaker) 116 and a second microphone 102. In various embodiments, the housing 115 is adapted to be worn behind or over the ear and the first microphone 101 is therefore worn above the pinna of a wearer's ear. In various embodiments, the receiver 116 is either mounted in the housing (e.g., as in a BTE design) or adapted to be worn in an ear canal of the user's ear (e.g., as in a receiver-in-canal design). In various embodiments, the second microphone 102 is adapted to receive sound from the entrance of the ear canal of the user's ear. In some embodiments, the second microphone 102 is adapted to be worn in the user's ear canal. In various embodiments, where the receiver is adapted to be worn in the user's ear canal, some designs include a second housing connected to the receiver, for example an ITE housing, a CIC housing, an earmold housing, or an ear bud. In various embodiments, a second microphone adapted to be worn in the user's ear canal, includes a second housing connected to the second microphone, for example an ITE housing, a CIC housing, an earmold housing, or an ear bud. In various embodiments, the second microphone 102 is housed in an outside-the-canal housing, for example a BTE housing, and includes a sound tube extending from the housing to inside the user's ear canal.

In the illustrated embodiment, the hearing assistance electronics 117 receive a signal ($M_o$) 105 from the first microphone 101, and a signal ($M_i$) 108 from the second microphone 102. An output signal 120 of the hearing assistance electronics is connected to the receiver 116. The hearing assistance electronics 117 include microphone mixing electronics 103 and other processing electronics 118. The other processing electronics 118 include an input coupled to an output 104 of the mixing circuit 103 and an output 120 coupled to the receiver 116. In various embodiments, the other processing electronics 118 apply hearing assistance processing to an audio signal 104 received from the microphone mixing circuit 103 and transmits an audio signal to the receiver 116 for broadcast to the user's ear. General amplification, frequency band filtering, noise cancellation, feedback cancellation and output limiting are examples of functions the other processing electronics 118 may be adapted to perform in various embodiments.

In various embodiments, the microphone mixing circuit 103 combines spatial cue information received using the second microphone 102 and speech information of lower audible frequencies received using the first microphone 101 to generate a composite signal. In various embodiments, the hearing assistance electronics include analog or digital components to process the input signals. In various embodiments, the hearing assistance electronics includes a controller or a digital signal processor (DSP) for processing the input signals. In various embodiments, the first microphone 101 is a directional microphone and the second microphone 102 is an omni-directional microphone.

Figure 1B:
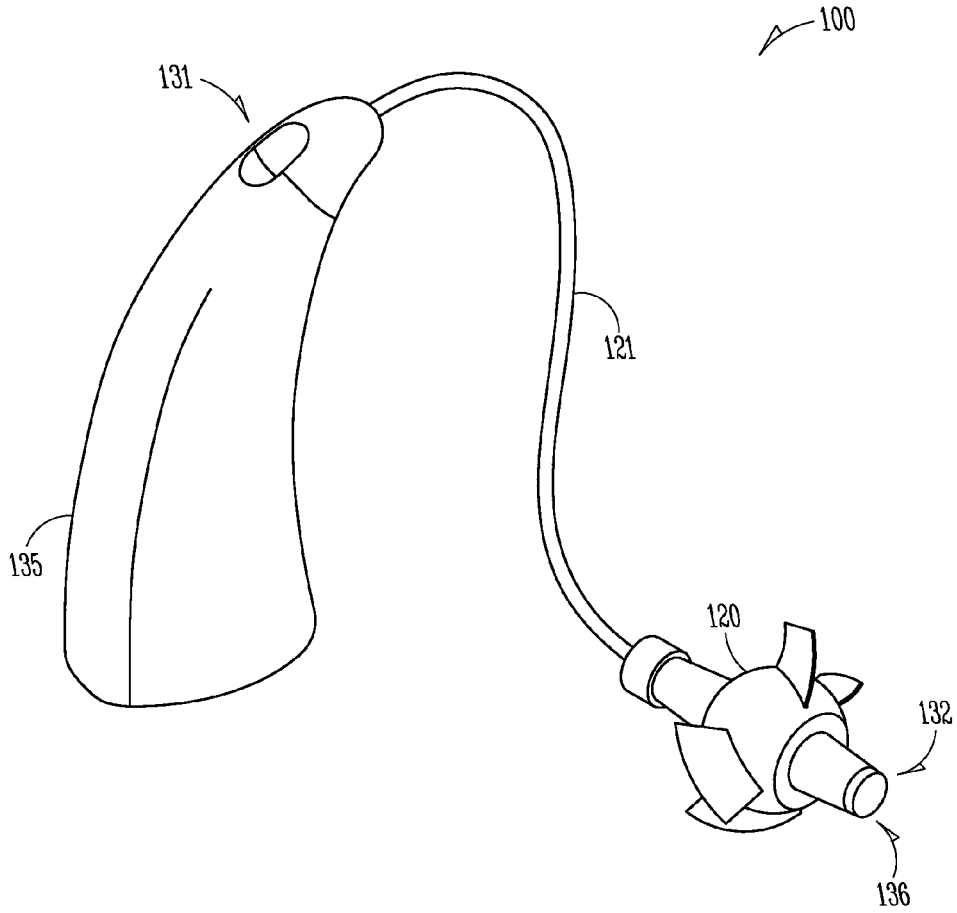
FIG. 1B illustrates a hearing assistance device according to one embodiment of the present subject matter.

FIG. 1B illustrates a hearing assistance device 100 according to one embodiment of the present subject matter. The illustrated device 100 includes a housing 135 adapted to be worn on, about or behind a user's ear and to enclose hearing assistance electronics, including microphone mixing electronics according to the teachings set forth herein. The device also includes a first microphone 131 integrated with the housing, an ear bud 120 for holding a second microphone 132 and a receiver 136, or speaker, a cable assembly 121 for connecting the receiver 136 and second microphone 132 to the hearing assistance electronics. It is understood that optional means for stabilizing the position of the ear bud 120 in the user's ear may be included. It is understood that the cable assembly 121 provides a plurality of wires for electrically connecting the receiver 136 and the second microphone 132. In one embodiment, four wires are used. In one embodiment, three wires are used. Other embodiments are possible without departing from the scope of the present subject matter.

Figure 2:
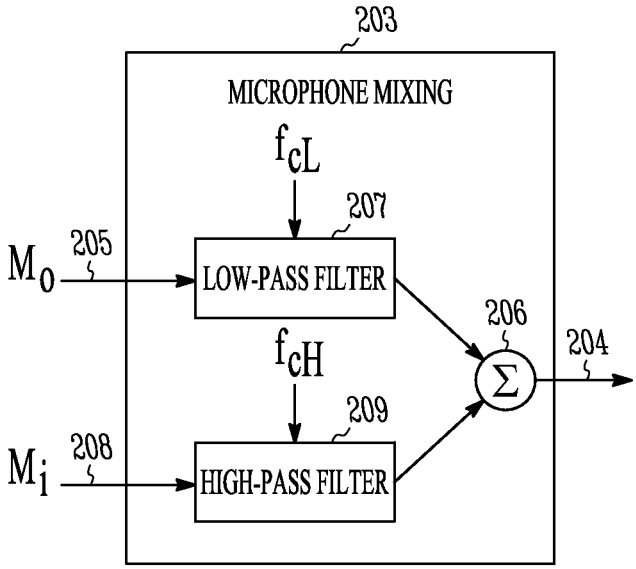
FIG. 2 is a signal flow diagram of microphone mixing electronics of a hearing assistance device according to one embodiment of the present subject matter.

FIG. 2 illustrates a signal flow diagram of microphone mixing electronics of a hearing assistance device according to one embodiment of the present subject matter. The mixer of FIG. 2 shows a first microphone ($M_o$) signal 205 that is low-pass filtered through low-pass filter 207 and combined by summer 206 with a high-pass filtered second microphone ($M_i$) signal 208 from high pass filter 209. The first microphone signal 205 is produced by a microphone external to a wearer's ear canal and the second microphone signal 208 is produced by a microphone receiving sound proximal with the ear canal of the user. The microphone mixing electronics 203 combine low frequency information received from the first microphone signal 205 and high frequency information received from the second microphone signal 208 to form a composite output signal 204. In various embodiments, the high-pass filter 209 is a band-pass filter that passes the high frequency information used for spatial cues.

Figure 3A:
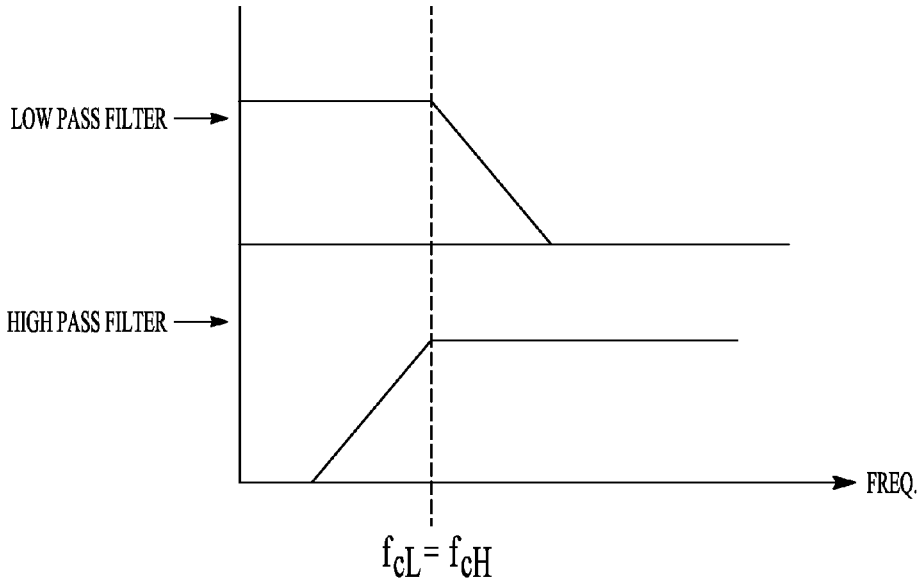
FIG. 3A illustrates frequency responses of a low-pass filter and a high-pass filter of microphone mixing electronics according to one embodiment of the present subject matter.

In various embodiments, the cutoff frequency of the low-pass filter $f_{cL}$ is approximately the same as the cutoff frequency of the high-pass filter $f_{cH}$. In various embodiments, the cutoff frequency of the low-pass filter $f_{cL}$ higher than the cutoff frequency of the high-pass filter $f_{cH}$. FIG. 3A illustrates frequency responses of the low-pass filter and the high-pass filter where the cutoff frequency of the low pass filter, $f_{CL}$, is approximately equal to the cutoff frequency of the high-pass filter $f_{cH}$. The values of the cutoff frequencies are adjustable for specific purposes. In some embodiments, a cutoff frequency of about 3 KHz is used. In some embodiments a cutoff frequency of approximately 5 KHz is used. In various embodiments, the cutoff frequencies are programmable. The present system is not limited to these frequencies, and other cutoff frequencies are possible without departing from the scope of the present subject matter.

Figure 3B:
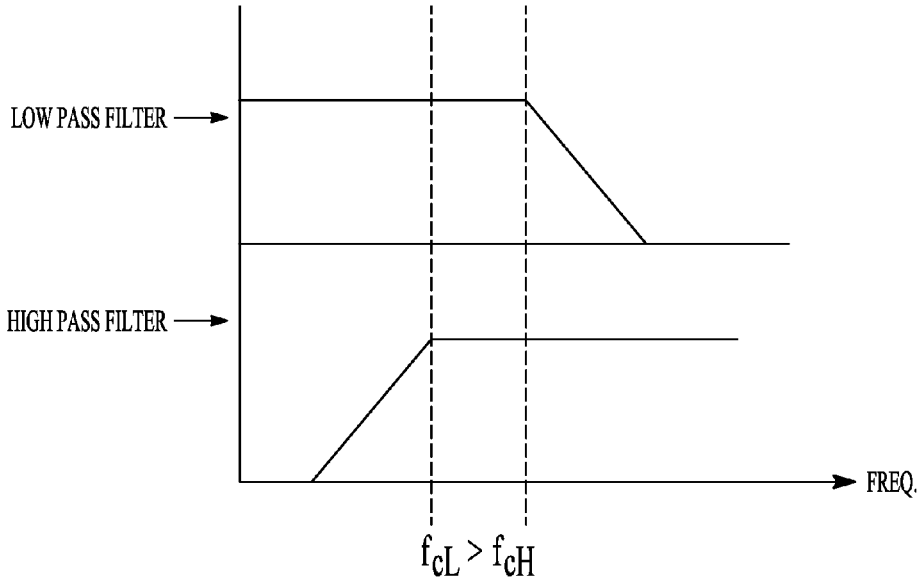
FIG. 3B illustrates examples of high and low pass filter frequency responses of microphone mixing electronics according to one embodiment of the present subject matter.

FIG. 3B illustrates high and low pass filter frequency responses of the microphone mixing electronics according to one embodiment of the present subject matter where the low-pass filter cutoff frequency is higher than the high-pass filter cutoff frequency. In various embodiments, the cutoff frequencies are programmable. In various embodiments, the values for the cutoff frequencies are between approximately 1 KHz and approximately 6 KHz. Other ranges possible without departing from the scope of the present subject matter. In various embodiments, the cutoff frequencies are programmable. In various embodiments, the value of the high-pass filter cutoff frequency is limited to be less than the value of the low-pass filter cutoff frequency.

In various embodiments, a hearing assistance device according to the present subject matter can be programmed to select between one or more cutoff frequencies for the low and high-pass filters. For example, the cutoff frequencies may be selected to enhance speech. The cutoff frequencies may be selected to enhance spatial perception.

A user in a crowded room trying to talk one on one with another person may select a higher cut-off frequency. Selecting a higher cut-off frequency emphasizes the external microphone over the ear canal microphone. In general, information contributing to intelligibility resides in the low-frequency part of the spectrum of speech. Emphasizing the low frequencies helps the user better understand target speech. In some embodiments, low frequencies are emphasized with the use of directional filtering of the external microphone. In contrast, lowering the cutoff frequency emphasizes the ear-canal microphone and thereby spatial cues conveyed by high frequencies. As a result, the user gets a better sense of where multiple sound sources are located around them and thereby facilitates, for example, the ability to switch between listening to different people in a crowded room.

Figure 4:
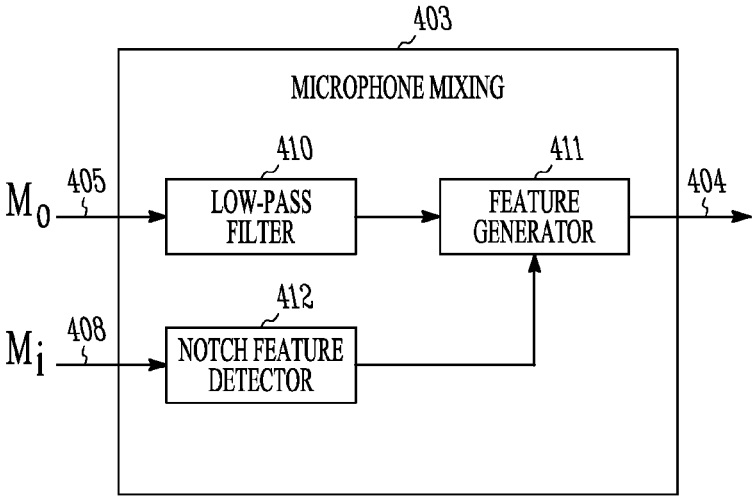
FIG. 4 is a signal flow diagram of microphone mixing electronics according to one embodiment of the present subject matter.

FIG. 4 illustrates a signal flow diagram of microphone mixing electronics according to one embodiment of the present subject matter. FIG. 4 shows a composite output signal 404 produced by a feature generator module 411 using a low-pass filtered first microphone ($M_o$) signal 405 and an output from a notch feature detector 412 based on the second microphone signal 408. The composite output signal 404 of the microphone mixing electronics 403 includes low frequency components of the first microphone signal 405 and spatial cue information derived from the notch feature detection of the second microphone signal 408.

The composite output signal 404 also includes features derived and created from the second microphone signal 408. In general, the second microphone signal 408 includes significant spatial cues resulting from sound received in the ear canal. The spatial cues result from the filtering effects of the user's head and torso, including the pinna and ear canal. The notch feature detector 412 quantifies the spatial features of the second microphone signal 408 and passes the data to the feature generator 411. In various embodiments, the notch feature detector 412 uses parametric spectral modeling to identify spatial features in the second microphone signal 408. The feature generator 411 modifies the filtered first microphone signal with data received from the notch feature detector 412 and indicative of the spatial cues detected from the second microphone signal 408. In various embodiments, the feature generator adds frequency data to create tones indicative of spatial cues detected in the second microphone signal. The frequency of the tones depends on the spatial features detected in the second microphone signal. In some embodiments, noise is added to the filtered first microphone signal using the feature generator 411. The bandwidth of the noise depends on the spatial features detected in the second microphone signal 408. In various embodiments, the feature generator 411 adds one or more notches in the spectrum of the filtered first microphone signal. The frequency of the notches depends on the spatial features detected in the second microphone signal 408. In some situations, the feature generator 411 generates artificial spatial cue at frequencies different than the spatial cues, or spatial features, detected in the second microphone signal 408, to accommodate hearing impairment of the user. In various embodiments, artificial spatial cues are created in the composite output signal at lower frequencies then the frequencies of cues detected in the second microphone signal 408 to accommodate hearing impairment of the user. It is understood that the described embodiments of the microphone mixing electronics may be implemented using a combination of analog devices and digital devices, including one or more microprocessors or a digital signal processor (DSP).

Figure 5:
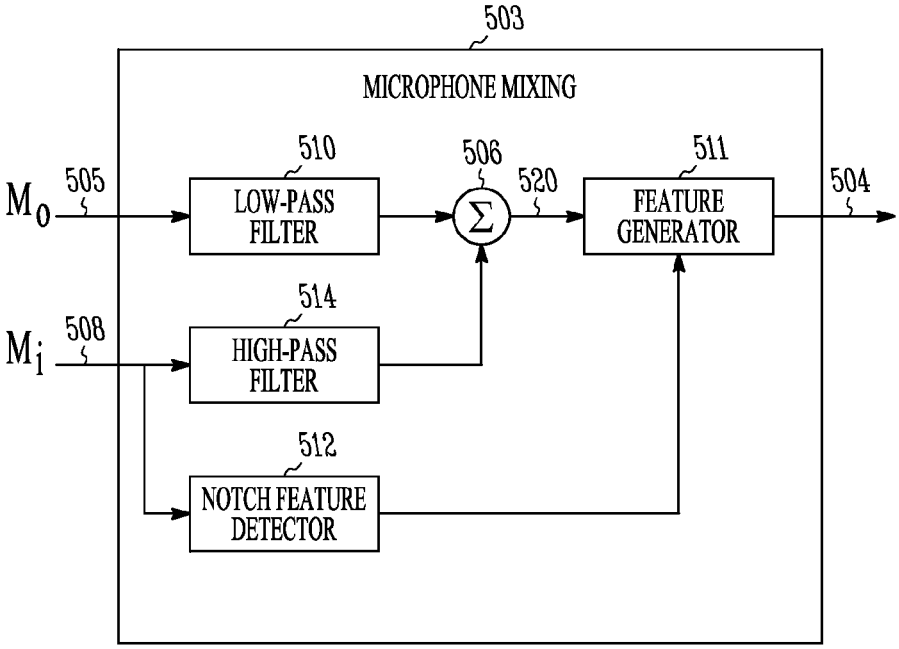
FIG. 5 is a flow diagram of microphone mixing electronics according to one embodiment of the present subject matter.

FIG. 5 illustrates a flow diagram of microphone mixing electronics according to one embodiment of the present subject matter. The microphone mixing electronics 503 include a low pass filter 510 applied to a first microphone ($M_o$) signal 505 from a microphone receiving sound from outside a user's ear canal, a high-pass filter 514 applied to a second microphone ($M_i$) signal 508 from a microphone receiving sound from inside a user's ear canal, a processing junction 506 combining the output of the low pass filter 510 and the high pass filter 514 to form a composite signal 520, a notch feature detector 512 for detecting spatial cues detected in the second microphone signal 508, and a feature generator 511 for modifying the composite signal 520 with information from the notch feature detector 512 to generate spatial features indicative of spatial cues detected in the second microphone signal 508.

The composite signal 520 of the microphone mixing electronics include low frequency components of the first microphone signal 505 and high frequency components of the second microphone signal 508. The low frequency components of the composite signal 520 are derived from applying the low pass filter 510 to the first microphone signal 505. In general, low frequency sound received from a microphone external to a user's ear or near the external opening of the user's ear canal, includes most components of perceptible speech but lacks some important spatial cues. The low pass filter 510 preserves the speech content of the first microphone signal 505 in the composite signal 520. The second microphone signal 508 includes significant spatial cues, or spatial features, as a result of filtering of the signal by the user's head and torso. The high pass filter 514 preserves spatial features of the second microphone signal 508 in higher acoustic frequencies, including frequencies above about 1 kHz. The processing junction 506 generates a composite signal 520 using the output signal data from the low-pass 510 and high-pass 514 filters.

In the illustrated embodiment, the composite output signal 504 of the microphone mixing electronics 503 includes additional features derived and created from the second microphone signal 508. From above, the second microphone signal 508 includes significant spatial cues resulting from sound received in the user's ear canal. The notch feature detector 512 quantifies the spatial features of the second microphone signal 508 and passes the data to the feature generator 511. In various embodiments, the notch feature detector 512 uses parametric spectral modeling to identify spatial features in the second microphone signal 508. The feature generator 511 modifies the composite signal 520 with data received from the notch feature detector and indicative of the spatial cues detected from the second microphone signal 508. In various embodiments, the feature generator 511 adds frequency data to create tones indicative of spatial cues detected in the second microphone signal 508. The frequency of the tones depends on the spatial features detected in the second microphone signal. In some embodiments, noise is added to the composite signal 520 using the feature generator 511. The bandwidth of the noise depends on the spatial features detected in the second microphone signal 508. In various embodiments, the feature generator 511 modifies the spectrum of the composite signal 520 with one or more notches. The frequency of the notches depends on the spatial features detected in the second. signal 508. In some situations, the feature generator 511 generates artificial spatial cue at frequencies different than the spatial cues, or spatial features, detected in the second microphone signal 508, to accommodate hearing impairment of the user. In various embodiments, artificial spatial cues are created in the composite output signal at lower frequencies then the frequencies of cues detected in the second microphone signal 408 to accommodate hearing impairment of the user. It is understood that the described embodiments of the microphone mixing electronics may be implemented using a combination of analog devices and digital devices, including one or more microprocessors or a digital signal processor (DSP).

In various embodiments, the feature generator 511 includes a filter. The output composite signal 504 includes signal components generated by applying the filter to the first microphone signal 505. One or more coefficients of the filter are determined from the second microphone signal 508 using parametric spectrum modeling. In various embodiments, the coefficients operate through the filter to modify the first microphone signal with high frequency notches to emphasize higher frequency spatial components in the composite output signal 504.

In various embodiments, the feature generator 511 includes one or more notch filters. In some embodiments, the frequency range of the one or more notch filters overlap. In various embodiments, one or more notch frequencies for the notch filters is selected from a range bounded by and including about 6 kHz at the low end to approximately 10 kHz at the high end. Other ranges possible without departing from the scope of the present subject matter. The notch filters modify the first microphone signal with high frequency notches to emphasize higher frequency spatial components in the composite output signal 504.

The present subject matter includes hearing assistance devices, including but not limited to, cochlear implant type hearing devices, hearing aids, such as behind-the-ear (BTE), and Receiver-in-the-ear (RIC) hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for playing processed sound to the ear of a wearer of a hearing assistance device, comprising:

receiving a first sound using a first microphone positioned outside the wearer's ear to produce a first microphone signal;

receiving a second sound using a second microphone positioned inside the wearer's ear to produce a second microphone signal;

forming a composite audio signal using the first microphone signal and the second microphone signal to provide the wearer with enhanced spatial perception, the composite audio signal having low frequency information from the first microphone signal and high frequency information including spatial cue information from the second microphone signal; and playing the composite audio signal to the ear of the wearer using the hearing assistance device.

2. The method of claim 1, comprising using a directional microphone as the first microphone.

3. The method of claim 2, comprising using an omnidirectional microphone as the second microphone.

4. The method of claim 1, comprising filtering the first microphone signal to obtain the low frequency information, and wherein forming the composite audio signal comprises mixing the first microphone signal and the second microphone signal electronically.

5. The method of claim 4, further comprising filtering the second microphone to obtain the high frequency information.

6. The method of claim 4, wherein the microphone mixing circuit comprises:

detecting spatial features from the second microphone signal; and generating an artificial spatial cue using the detected spatial features.

7. The method of claim 6, wherein detecting the spatial features comprises detecting the spatial features using parametric spectral modeling.

8. The method of claim 6, wherein generating the artificial spatial cues comprises adding frequency data to the filtered first microphone signal to create tones having a frequency depending on the detected spatial features.

9. The method of claim 6, wherein generating the artificial spatial cues comprises adding noise to the filtered first microphone signal, the noise having a bandwidth depending on the detected spatial features.

10. The method of claim 6, wherein generating the artificial spatial cues comprises adding a notch in the spectrum of the filtered first microphone signal, the notch having a frequency depending on the detected spatial features.

11. A method for operating a hearing aid for use by a wearer having an ear with an ear canal, comprising:

receiving a first sound using a first microphone of the hearing aid, the first microphone positioned outside the ear when the hearing aid is worn by the wearer;

receiving a second sound using a second microphone of the hearing aid, the second microphone positioned inside the wearer's ear canal when the hearing aid is worn by the wearer;

forming a composite audio signal having low frequency information from the first microphone and high frequency information including spatial cue information from the second microphone; and playing the composite audio signal to the ear of the wearer to provide the wearer with enhanced spatial perception.

12. The method of claim 11, comprising:

receiving a second microphone signal from the second microphone;

detecting spatial features in the second microphone signal; and generating an audible artificial spatial cue using the detected spatial features.

13. The method of claim 12, comprising:

filtering the second microphone signal using a high-pass filter; and detecting spatial features in the filtered second microphone signal.

14. The method of claim 12, comprising:

receiving a first microphone signal from the first microphone; and modifying the first microphone signal using frequency information associated with the detected spatial features.

15. The method of claim 14, comprising:

filtering the first microphone signal using a low-pass filter; and modifying the filtered first microphone signal using frequency information associated with the detected spatial features.

16. The method of claim 14, wherein detecting the spatial features comprises detecting the spatial features using parametric spectral modeling.

17. The method of claim 14, comprising adding frequency data to the first microphone signal to create tones having a frequency depending on the detected spatial features.

18. The method of claim 14, comprising adding noise to the filtered first microphone signal, the noise having a bandwidth depending on the detected spatial features.

19. The method of claim 14, comprising adding a notch in the spectrum of the filtered first microphone signal, the notch having a frequency depending on the detected spatial features.

20. The method of claim 14, comprising using a directional microphone as the first microphone and an omni-directional microphone as the second microphone.

* * * * *